US006981755B2

(12) United States Patent
Lim

(10) Patent No.: US 6,981,755 B2
(45) Date of Patent: Jan. 3, 2006

(54) PRINT HEAD POSITION ADJUSTING APPARATUS OF INK-JET PRINTER

(75) Inventor: Gui-taek Lim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 20 days.

(21) Appl. No.: 10/442,253

(22) Filed: May 21, 2003

(65) Prior Publication Data

US 2004/0051754 A1 Mar. 18, 2004

(30) Foreign Application Priority Data

Sep. 17, 2002 (KR) ..... 10-2002-0056612

(51) Int. Cl.
*B41J 2/015* (2006.01)

(52) U.S. Cl. ..... 347/20
(58) Field of Classification Search ..... 347/40, 347/20, 37
See application file for complete search history.

(56) References Cited

U.S. PATENT DOCUMENTS

| | | | | |
|---|---|---|---|---|
| 4,675,696 A | * | 6/1987 | Suzuki | 346/46 |
| 5,317,339 A | | 5/1994 | Braun et al. | 347/87 |
| 5,467,116 A | | 11/1995 | Nakamura et al. | 347/50 |
| 5,552,816 A | | 9/1996 | Oda et al. | 347/86 |
| 6,089,696 A | * | 7/2000 | Lubinsky | 347/40 |
| 6,092,887 A | * | 7/2000 | Tanino et al. | 347/37 |
| 6,174,044 B1 | * | 1/2001 | Yun | 347/40 |

FOREIGN PATENT DOCUMENTS

JP 5-057885 3/1993

OTHER PUBLICATIONS

Patent Abstracts of Japan, Publication No. 05–057885, published Mar. 9, 1993.

* cited by examiner

*Primary Examiner*—Thinh Nguyen
(74) *Attorney, Agent, or Firm*—Staas & Halsey LLP

(57) ABSTRACT

A print head position adjusting apparatus of an ink jet printer includes at least one stitching adjustment unit disposed at the carrier to adjust an orientation of a print head, and at least one resilient pressing unit resiliently pressing the print head toward the stitching adjustment unit. The stitching adjustment unit includes a supporting knob movably disposed at a wall of the carrier to press a surface of the print head facing the wall of the carrier, and an adjusting knob moving in association with the supporting knob to push or release the supporting knob toward or from the surface of the print head. Accordingly, the print head position adjusting apparatus is capable of adjusting the orientations of the print head mounted in the carrier with a relatively simplified structure, thereby preventing a stitching problem that is caused by the misalignment of the print head.

52 Claims, 10 Drawing Sheets

PRINT HEAD POSITION ADJUSTING APPARATUS OF INK-JET PRINTER

CROSS-REFERENCE TO RELATED APPLICATIONS

This application claims the benefit of Korean Application No. 2002-56612, filed Sep. 17, 2002, in the Korean Intellectual Property Office, the disclosure of which is incorporated herein by reference.

BACKGROUND OF THE INVENTION

1. Field of the Invention

The present invention relates to an ink-jet printer, and more particularly, to a print head position adjusting apparatus of an ink-jet printer capable of adjusting an orientation of a print head mounted in a carrier, thereby preventing a stitching problem.

2. Description of the Related Art

There are many types of printers printing data or a file created by a user using a computer. For example, an ink-jet printer performs a printing process in a manner that a bubble, which is generated by heating ink stored in an ink cartridge constituting a print head (Hereinafter, it is referred to as "print head"), causes the ink to be ejected onto a sheet of paper through a nozzle in a predetermined pattern.

As shown in FIGS. 1 and 2, a conventional ink-jet printer 10 includes a paper feeding device 20 on which sheets of paper P are stacked, a conveying device 30 conveying the paper P from the paper feeding device 20, a printing device 40 having a print head 41 mounted in a carrier moving along a carrier shaft 42 in left and right directions to perform printing with respect to the paper P conveyed by the conveying device 30, and a discharging device 60 discharging the printed paper P from the printing device 40 to an outside of the ink-jet printer 10.

As shown in FIGS. 3 and 4, the ink jet printer 10 is provided with a balancing shaft 44 disposed at a lower portion of the carrier 46 to allow the print head 41 seated on a lower supporting portion 45 of the carrier 46 to be secured in position, in this instance, a position where a lower securing surface 23 of the print head 41 is in a parallel relationship with a carrier shaft 42, so that the ink can be precisely ejected onto the paper P while the print head 41 moves along the carrier shaft 42 to perform the printing.

Operations of the ink jet printer 10 having the above structure are described hereinbelow in conjunction with FIGS. 1 through 4. The paper P is stacked on the paper feeding device 20 and resiliently supported by a rock-up spring 21, is picked-up by a pickup roller 22, and then is supplied to the conveying device 30.

Next, the paper P is transferred to the printing device 40 by rotations of a feed roller 31 and a friction roller 32 of the conveying device 30. As the paper P is transferred from the conveying device 30 to the printing device 40, a carrier driving motor 47 is driven to activate a belt 43. Accordingly, while the carrier 46 moves along the carrier shaft 42 together with the print head 41, which is contained in the carrier 46 and has a nozzle 41*a* attached thereto to eject the ink, the print head 41 ejects the ink onto the paper P conveyed from the conveying device 30 to print data on the paper P.

The paper onto which the data is printed by the ink ejected from the nozzle 41*a* of the print head 41, moves on a base frame 50, gradually reaches the discharging device 60, and then is discharged through a discharging roller 61 and a star-shaped wheel 62.

However, in the conventional ink jet printer 10, the balancing shaft 44 allowing the print head 41 to be in position is secured to the carrier 46 and thus is not movable with respect to the carrier 46. Accordingly, when the securing surface 23 of the print head 41 is positioned with an improper orientation due to errors of fabrication and assembly of the ink jet printer 10, for example, when the securing surface 23 is not parallel to the balancing shaft 44 attached to the carrier 46 or when there occurs a misalignment, such as an unparallel relationship, between the balancing shaft 44 and the carrier shaft 42, there is no way to adjust the improper orientation of the printing head 41.

Also, even though the print head 41 is precisely positioned initially, the print head 41 becomes deviated from an initial position by a mechanical abrasion and a work load during a long time printing work and thus cannot maintain the parallel relationship with the balancing shaft 44 or the carrier shaft 42.

As described above, if the print head 41 cannot maintain the parallel relationship with the balancing shaft 44 or the carrier shaft 42, there occurs a stitching problem so that the ink ejected from the nozzle 41*a* of the print head 41 onto the paper P is skewed at each swath-to-swath boundary in a printed image, and thus a printing quality deteriorates. The stitching problem more seriously affects the image quality deterioration when the data to be printed relates to a perpendicular line or image.

SUMMARY OF THE INVENTION

The present invention has been developed in order to solve the above and/or other problems. Accordingly, an aspect of the present invention is to provide a print head position adjusting apparatus of an ink jet printer of a relatively simplified structure, which is capable of adjusting an orientation of a print head mounted in a carrier to prevent a stitching problem caused by a misalignment of the print head.

Additional aspects and advantages of the invention will be set forth in part in the description which follows and, in part, will be obvious from the description, or may be learned by practice of the invention.

The above and/or other aspects of the present invention is achieved by providing a print head position adjusting apparatus of an ink jet printer which includes at least one print head performing printing by ejecting ink and a carrier containing the print head therein and moving along a carrier shaft. The print head position adjusting apparatus includes at least one stitching adjustment unit disposed at the carrier to adjust an orientation of the print head, and at least one resilient pressing unit resiliently pressing the print head toward the stitching adjustment unit.

The stitching adjustment unit includes a supporting knob movably disposed at a wall of the carrier to press a surface of the print head facing the wall of the carrier, and an adjusting knob disposed at the wall of the carrier to push or release the supporting knob toward or from the surface of the print head.

The supporting knob includes a contacting member having a contacting surface contacting the surface of the print head, and a supporting hook being supported by the wall of the carrier to move the contacting member within a predetermined range.

Also, the supporting knob further includes a resilient spring disposed between the contacting member and the wall of the carrier to press the contacting member toward the surface of the print head. It is possible that the resilient spring includes a coil spring.

The adjusting knob includes a screw bar that is screwed into a screw hole formed on the wall of the carrier and has one end rotatably contacting the contacting member and the other end having a gripper. The gripper includes a plurality of rips to be easily held by a user hand.

According to another aspect of the invention, the adjusting knob includes a screw bar that has one end rotatably and securely supported by the contacting member and the other end having a gripper. At this point, the resilient spring disposed between the contacting member and the wall of the carrier to press the contacting member toward the surface of the print head is not required.

The resilient pressing unit includes at least one resilient spring disposed between a second surface of the print head opposite to the surface of the print head and a second wall of the carrier facing the second surface of the print head to resiliently press the print head toward the supporting knob.

It is possible that the resilient spring includes a plate spring having one end fastened to and supported on the second wall of the carrier and the other end contacting the second surface of the print head.

In a case that the supporting knob includes the coil spring disposed between the contacting member and the wall of the carrier and winding around the screw bar so that the end of the coil spring rotatably contacts the contacting member, it is possible that the plate spring of the resilient pressing unit has a greater resilient force than that of the coil spring of the supporting knob. Accordingly, when the adjusting knob is released from the wall of the carrier, the plate spring of the resilient pressing unit is enabled to push the print head toward the supporting knob.

Also, the stitching adjustment unit includes a securing member securing the adjusting knob at an adjustment position after an orientation of the print head is adjusted by the adjusting knob.

The securing member includes either a plurality of first screw holes or pin holes formed on the adjusting knob and a plurality of second screw or pin holes formed on the wall of the carrier, and either screws or pins inserted into corresponding ones of the first screw holes or pin holes of the adjusting knob and the second screw holes or pin holes of the wall of the carrier, thereby preventing a rotation of the adjusting knob with respect to the wall of the carrier.

According to another aspect of the present invention, a print head position adjusting apparatus of an ink jet printer includes a carrier shaft and a carrier moving along the carrier and having first, second, and intermediate sidewalls to contain a mono print head between the first and intermediate sidewalls and a color print head between the intermediate and second sidewalls to perform printing on a sheet of paper, a first stitching adjusting unit formed on the first sidewall to push the mono print head toward a first side of the intermediate sidewall facing the first sidewall, a second stitching adjusting unit formed on the second sidewall to push the color print head toward a second side of the intermediate sidewall facing the second sidewall, a first resilient member disposed on the first side of the intermediate sidewall to push the mono print head toward the first sidewall, and a second elastic member disposed on the second side of the intermediate sidewall to push the color print head toward the second sidewall.

According to another aspect to the present invention, a print head position adjusting apparatus of an ink jet printer includes a carrier shaft and a carrier moving along the carrier and having first and second sidewalls to contain a print head between the first and second sidewalls to perform printing on a sheet of paper, a stitching adjusting unit formed on the first sidewall to push the print head toward the second sidewall, and a resilient member disposed on an inside of the second sidewall facing the first sidewall to push the print head toward the first sidewall.

According to another aspect of the present invention, a method in a print head position adjusting apparatus of an ink jet printer which includes a carrier shaft and a carrier moving along the carrier and having first, second, and intermediate sidewalls to contain a mono print head between the first and intermediate sidewalls and a color print head between the intermediate and second sidewalls to perform printing on a sheet of paper, includes causing a first stitching adjusting unit to be formed on the first sidewall, causing a second stitching adjusting unit to be formed on the second sidewall, causing a first resilient member to be disposed on a first side of the intermediate sidewall facing the first sidewall to push the mono print head toward the first sidewall, causing a second resilient member to be disposed on a second side of the intermediate sidewall facing the third sidewall to push the color print head toward the second sidewall, moving the first stitching adjusting unit to push the mono print head toward the intermediate sidewall, and moving the first stitching adjusting unit to push the color print head toward the intermediate sidewall.

According to another aspect of the present invention, a method in a print head position adjusting apparatus of an ink jet printer which includes a carrier shaft and a carrier moving along the carrier and having first and second sidewalls to contain a print head between the first and second sidewalls to perform printing on a sheet of paper, includes causing a stitching adjusting unit to be formed on the first sidewall, causing a resilient member to be disposed on an inside of the second sidewall facing the first sidewall to push the print head toward the first sidewall, and controlling the moving the stitching adjusting unit to push the print head toward the second sidewall.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
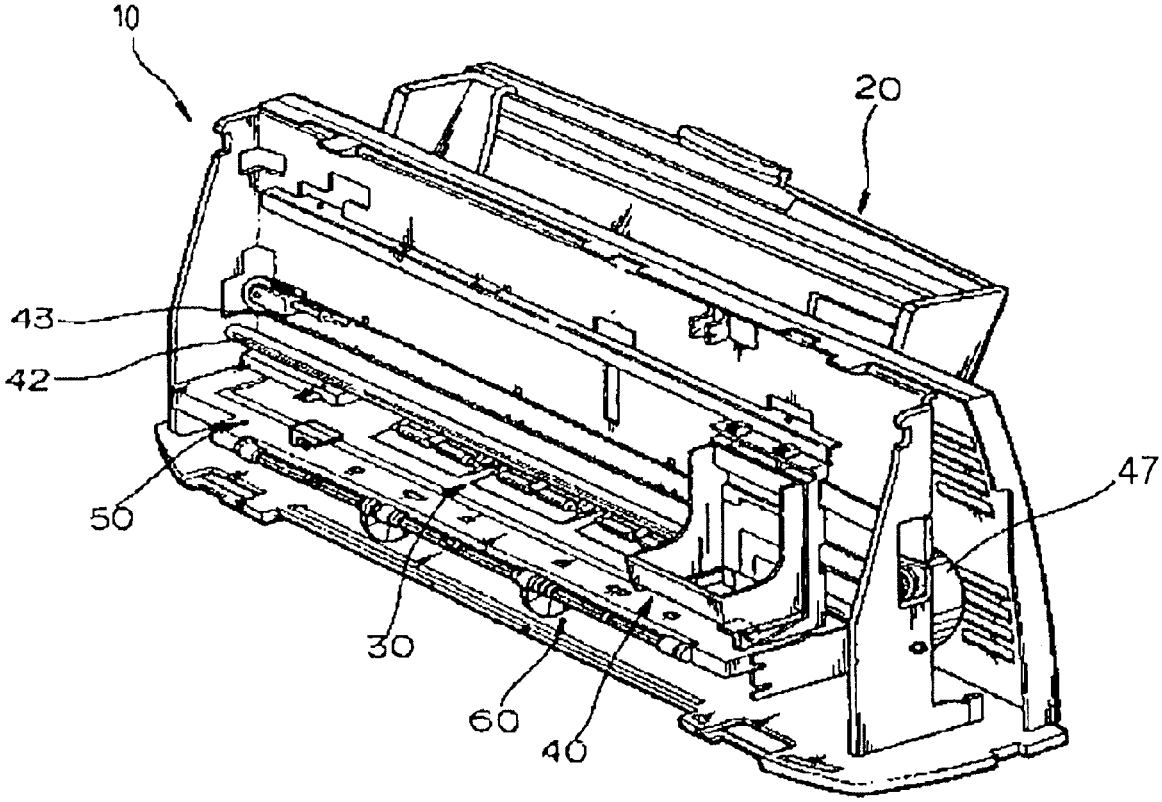
FIG. 1 (PRIOR ART)
FIG. 1 is a partial perspective view showing a conventional ink jet printer.
Figure 2:
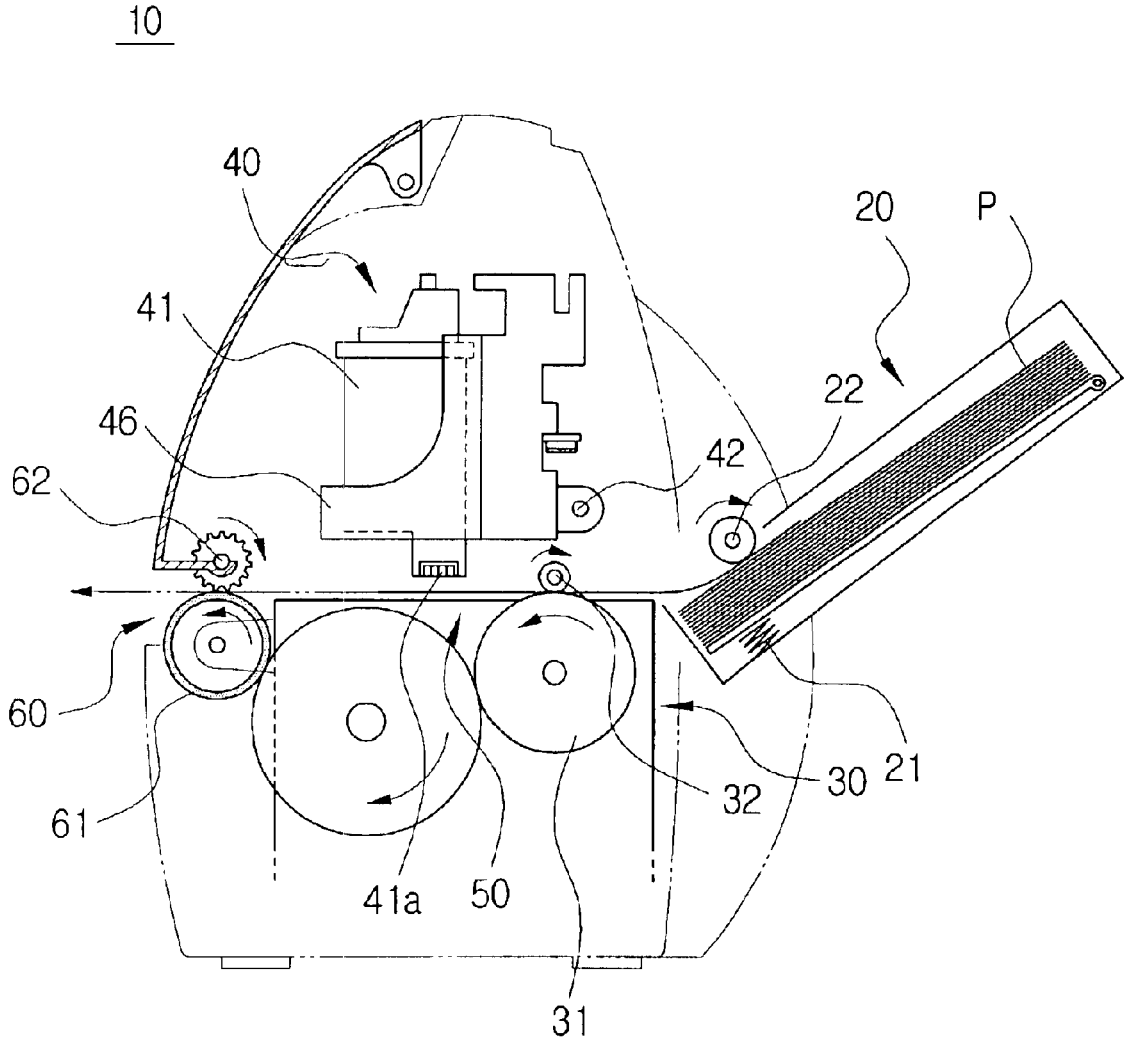
FIG.2 (PRIOR ART)
FIG. 2 is a schematic cross-sectional view showing the conventional ink jet printer shown in FIG. 1.
Figure 3:
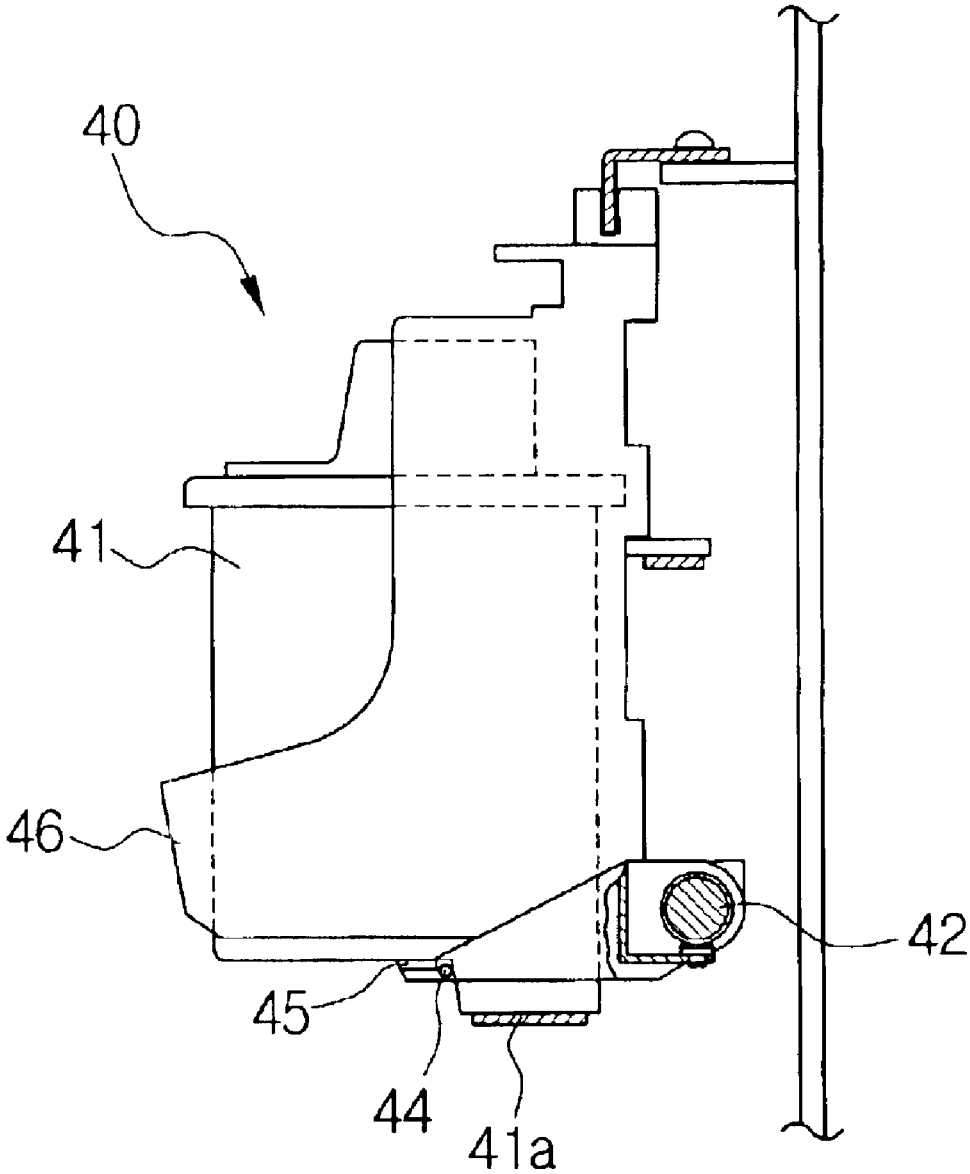
FIG.3 (PRIOR ART)
FIG. 3 is a side view showing a carrier assembly of the ink jet printer of FIG. 1.
Figure 4:
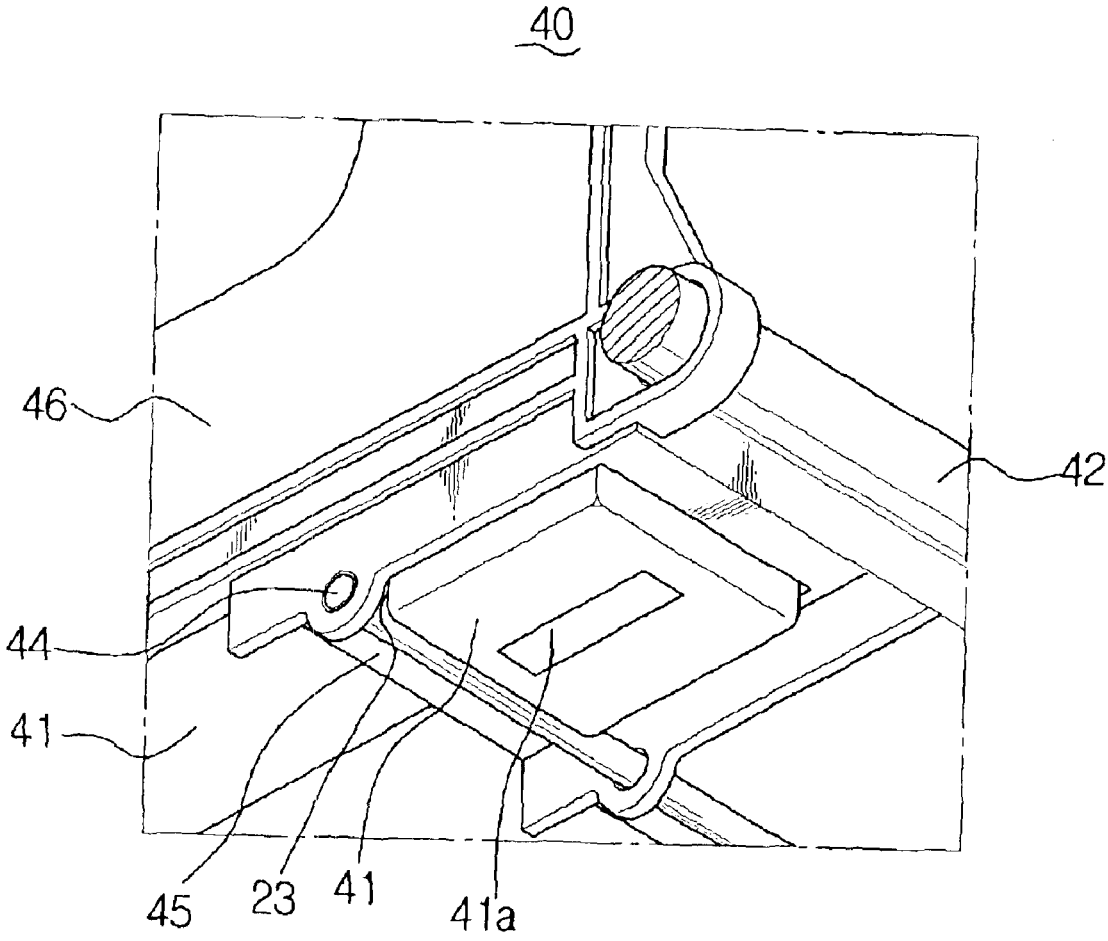
FIG.4 (PRIOR ART)
FIG. 4 is a partial perspective view showing the carrier assembly of FIG. 3.

Reference will now be made in detail to the present preferred embodiment of the present invention, examples of which are illustrated in the accompanying drawings, wherein like reference numerals refer to the like elements throughout. The embodiment is described below in order to explain the present invention by referring to the figures.

Hereinafter, a print head position adjusting apparatus of an ink jet printer according to an embodiment of the present invention will be described in greater detail with reference to the accompanying drawings.

Figure 5:
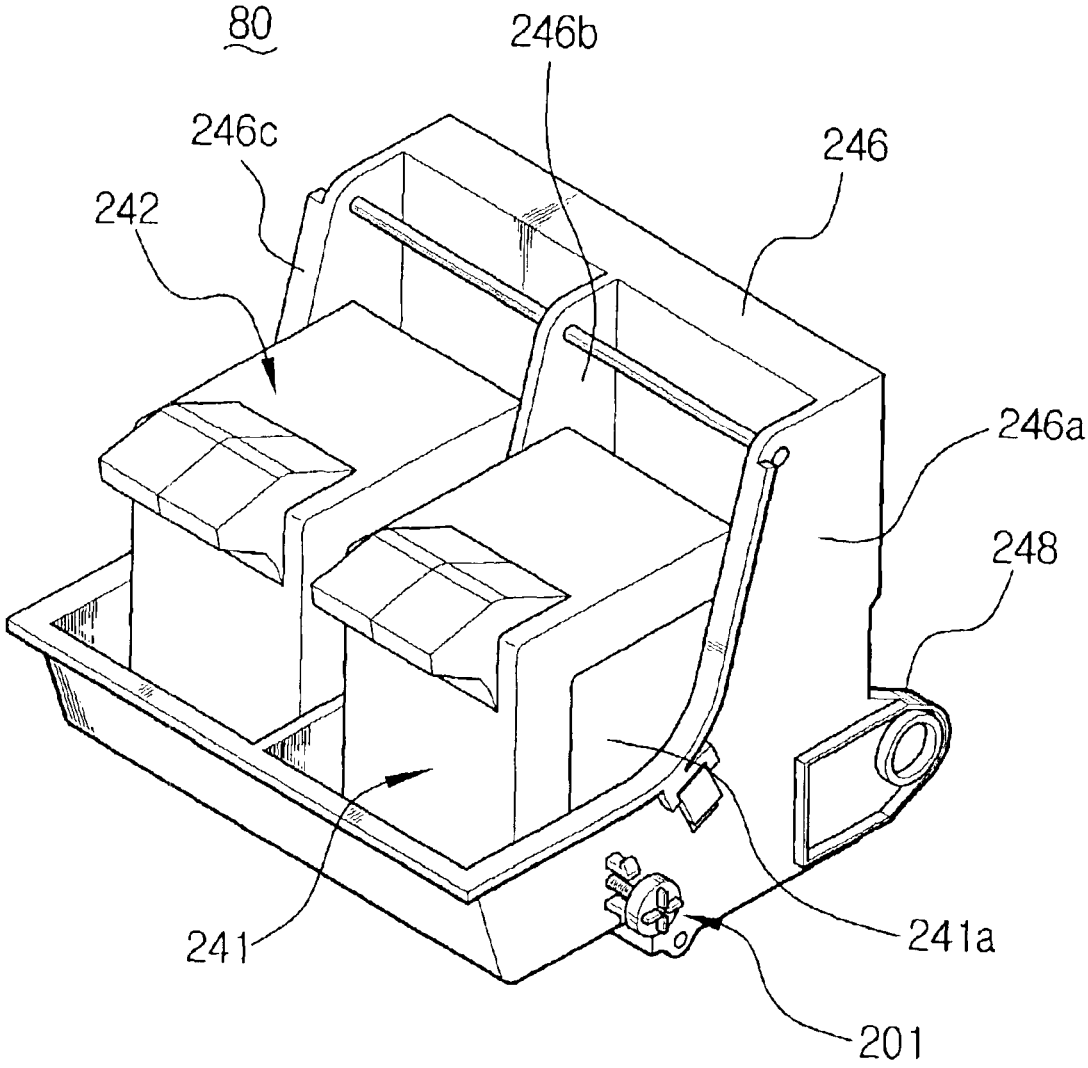
FIG. 5 is a perspective view showing a carrier assembly employing a print head position adjusting apparatus according to an embodiment of the present invention.

FIG. 5 shows a carrier assembly 80 mounted in the ink jet printer to transfer a mono print head 241 and a color print head 242, each employing the print head position adjusting apparatus.

The carrier assembly 80 includes a carrier 246 containing the mono and color print heads 241 and 242 therein, a carrier shaft guide 248 supportably holding a carrier shaft (not shown) to allow the carrier 246 to move along the carrier shaft, and two print head position adjusting apparatuses 200 and 200' respectively adjusting orientations of the mono and color print heads 241 and 242, which are illustrated in FIG. 6 through FIG. 9 by way of an example.

Figure 8A:
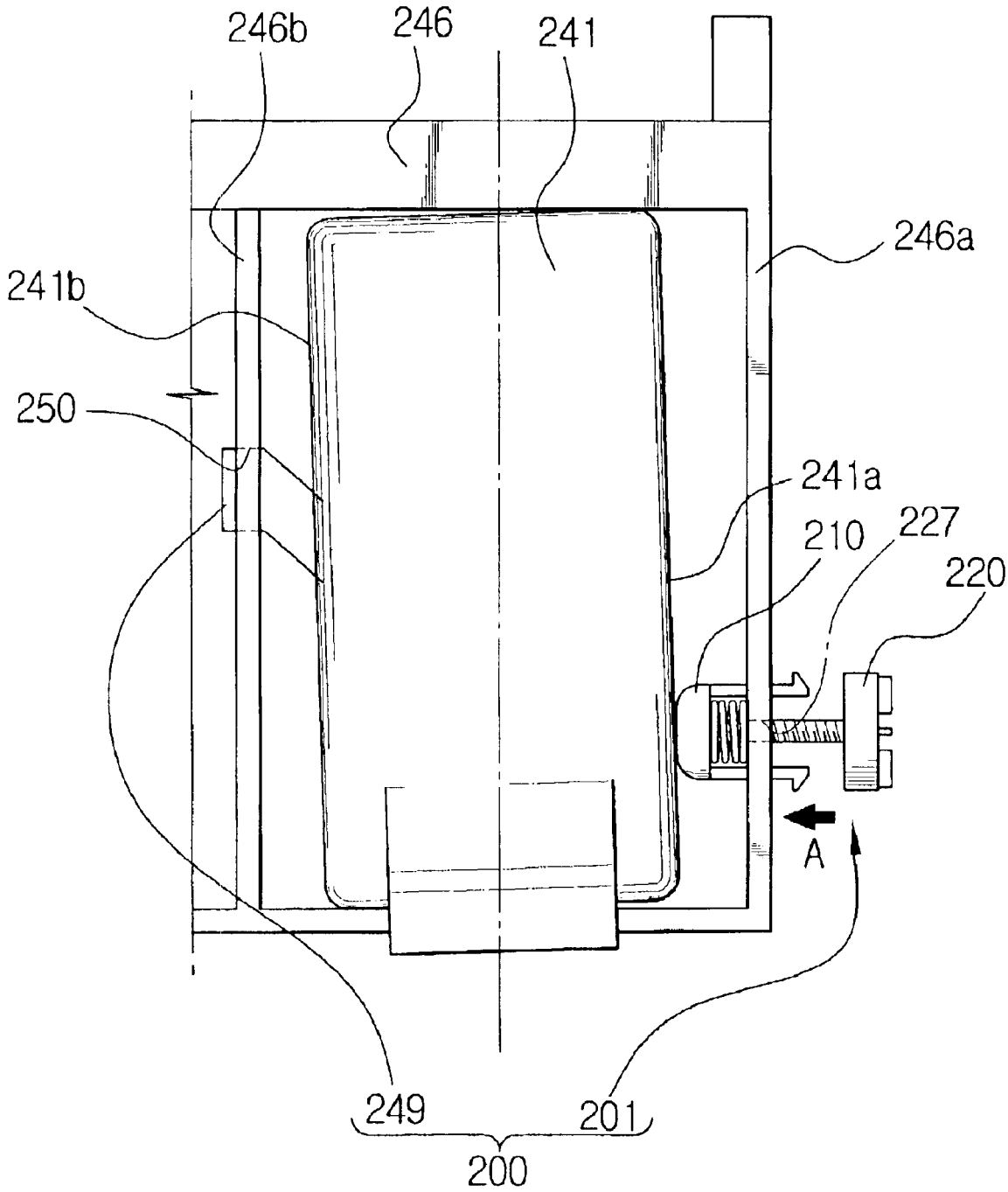
FIGS. 8A and 8B are partial plane views showing operations of the print head position adjusting apparatus of FIG. 5.
Figure 8B:
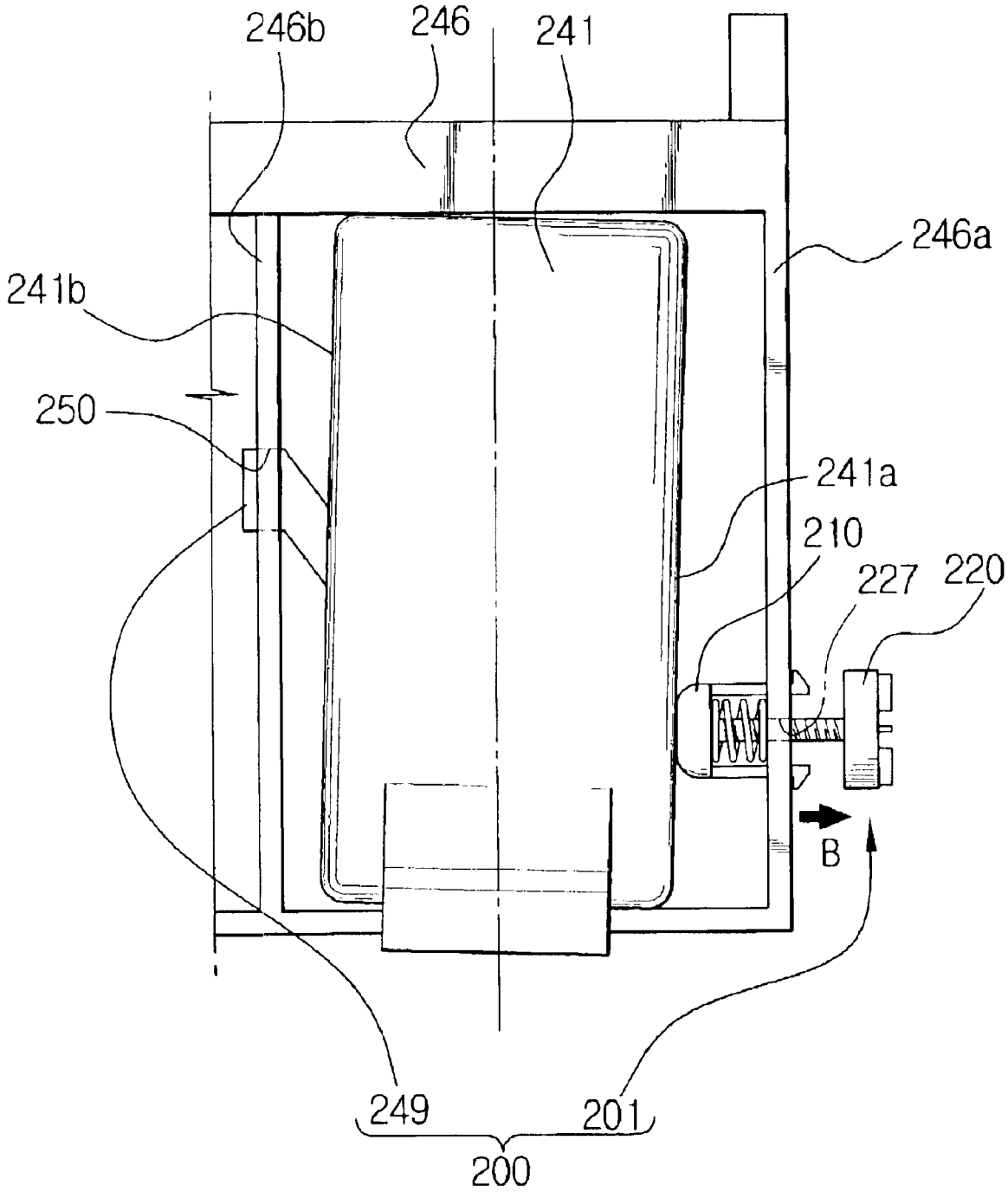
Figure 9:
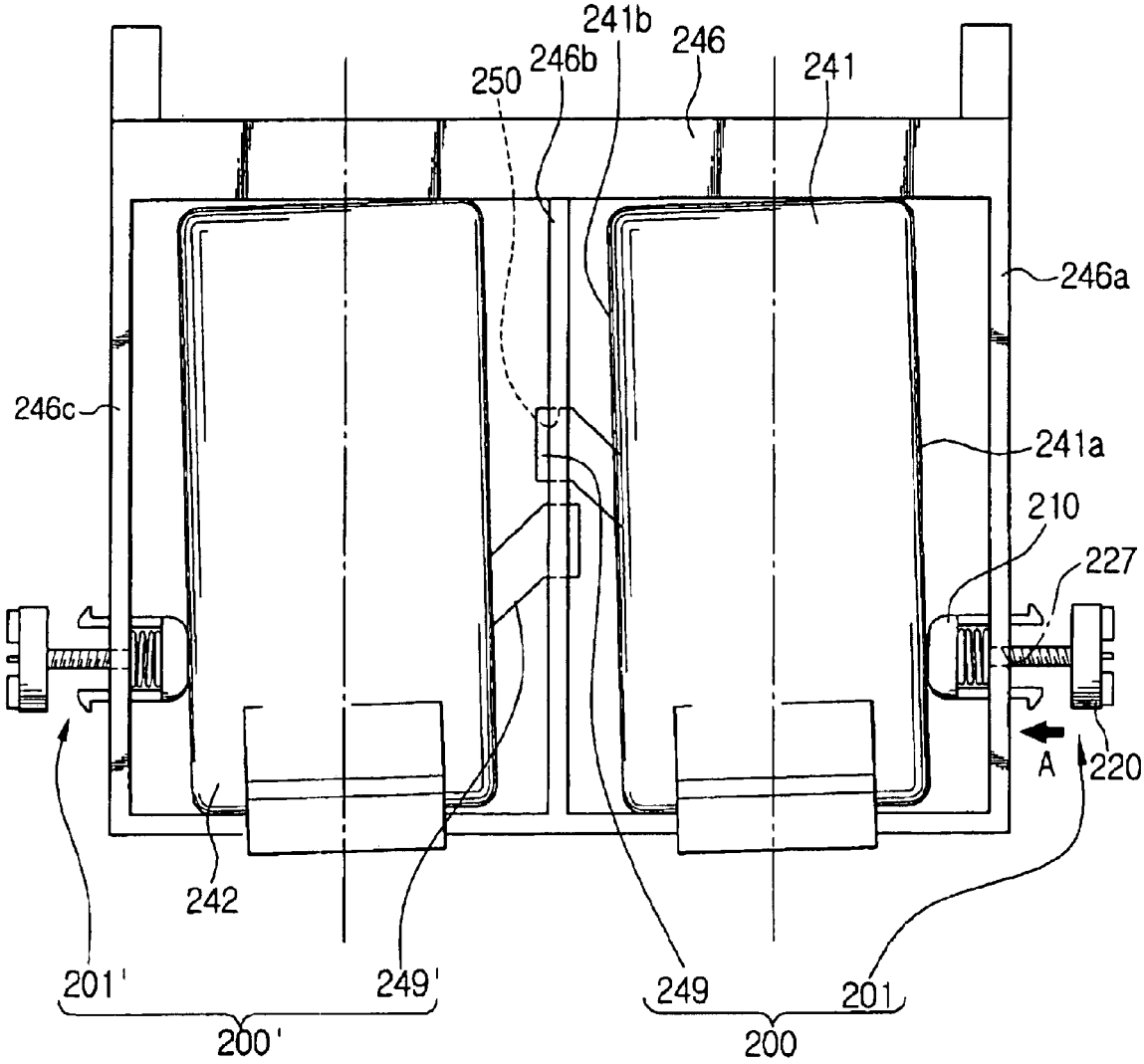
FIG. 9 is a top view illustrating particularly the stitching adjusting units.

As shown in FIGS. 8A and 8B, the print head position adjusting apparatus 200 for the mono print head 241 includes a stitching adjustment unit 201 disposed at a front portion of the mono print head 241, i.e., at a sidewall 246*a* of the carrier 246, to adjust the orientation of the mono print head 241, and a resilient pressing unit 249 disposed at an intermediate wall 246*b* of the carrier 246 to resiliently press the mono print head 241 toward the stitching adjustment unit 201.

Figure 6:
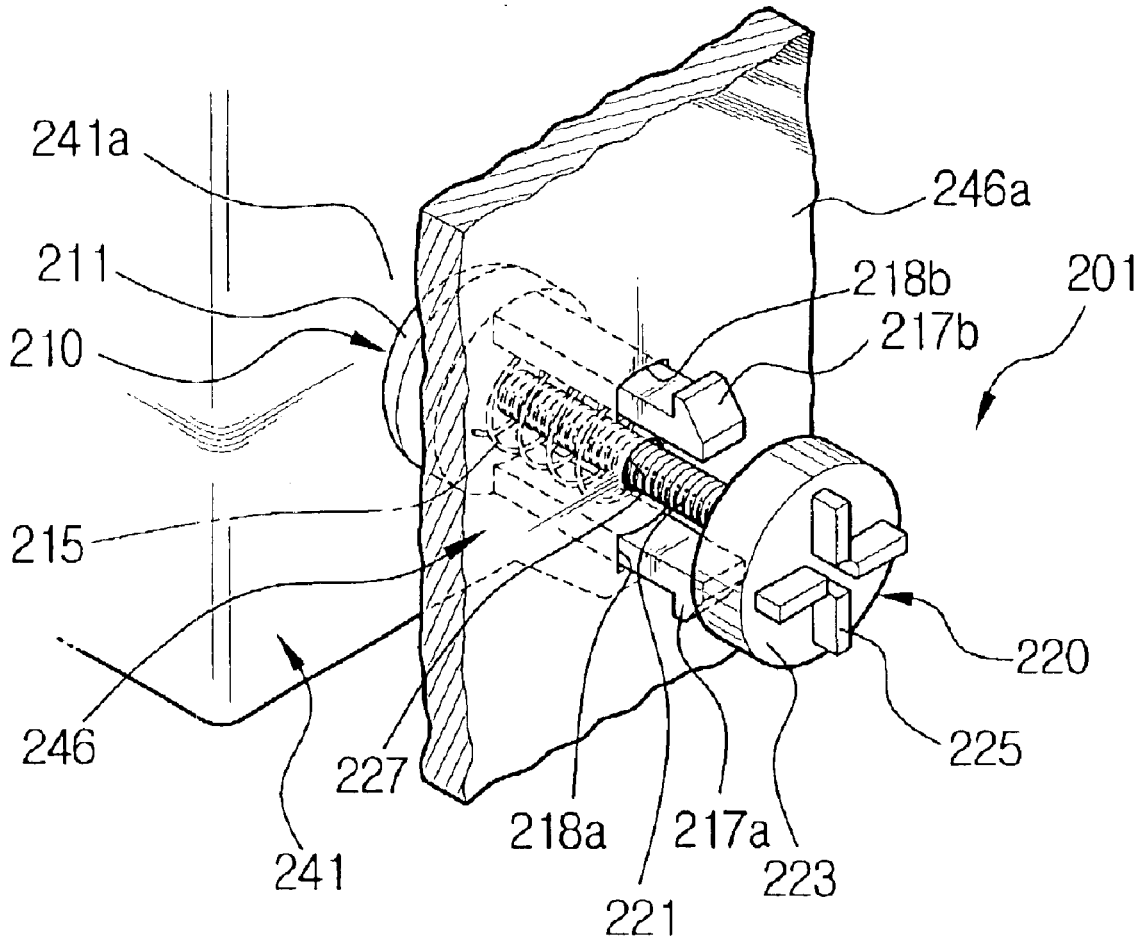
FIG. 6 is a partial perspective view showing a stitching adjustment unit of the print head position adjusting apparatus of FIG. 5.
Figure 7:
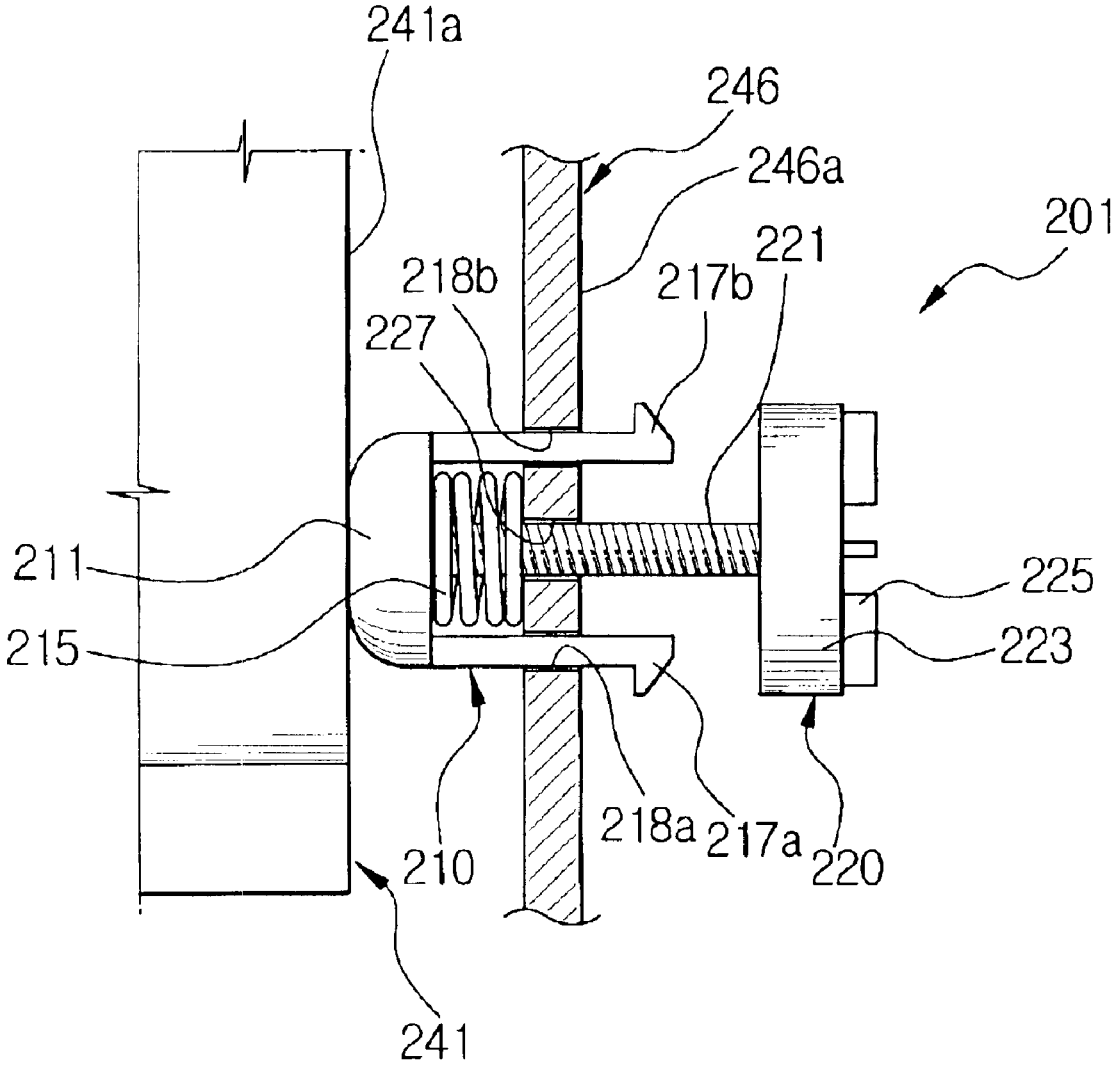
FIG. 7 is a partial cross-sectional view showing the stitching adjustment unit of the print head position adjusting apparatus of FIG. 5.

Referring to FIGS. 6 and 7, the stitching adjustment unit 201 includes a supporting knob 210 movably disposed on the sidewall 246*a* of the carrier 246 to press a side surface 241*a* of the mono print head 241, and an adjusting knob 220 disposed on the sidewall 246*a* of the carrier 246 to push or separate the supporting knob 210 toward or from the side surface 241*a* of the mono print head 241.

The supporting knob 210 includes a contacting member 211 having a contacting surface contacting the side surface 241*a* of the print head 241, and a first supporting hook 217*a* and a second supporting hook 217*b* respectively supported on a first slide groove 218*a* and a second slide groove 218*b* formed on the sidewall 246*a* of the carrier 246 to slidably move the contacting member 211 within a predetermined range.

In order for the supporting knob 210 to be in contact with the side surface 241*a* of the mono print head 241 with a predetermined pressure, the supporting knob 210 further includes a coil spring 215. The coil spring 215 is disposed between the contacting member 211 and an inner surface of the sidewall 246*a* of the carrier 246 to press the contacting member 211 toward the side surface 241*a* of the print head 241.

The adjusting knob 220 is shaped in a screw bar 221 so that it is screwed into a screw hole 227 formed on the sidewall 246*a* of the carrier 246, and has one end rotatably contacting the contacting member 211and the other end having a gripper 223. The gripper 223 has a plurality of ribs 225 formed on an outer side thereof to be easily gripped by a user hand.

Accordingly, as the adjusting knob 220 rotates in a fastening direction to advance into the screw hole 227 formed on the sidewall 246*a* of the carrier 246, the contacting member 211 of the supporting knob 210 is pressed in an arrow direction "A" of FIG. 8A, i.e., to the left side of FIGS. 6 and 8A. Then, a front portion of the side surface 241*a* of the print head 241 is pushed to the left side against the resilient pressing unit 249, and accordingly, the orientation of the mono print head 241 is adjusted.

Also, as the adjusting knob 220 rotates in a releasing direction from the screw hole 227, an end of the adjusting knob 220 is separated from the contacting member 211 of the supporting knob 210 in an arrow direction "B" of FIG. 8B. Then, a front portion of the side surface 241*a* of the print head 241 moves in the arrow direction "B" due to a resilient force of the resilient pressing unit 249 that is greater than that of the coil spring 215, and accordingly, the orientation of the mono print head 241 is adjusted.

Selectively, the adjusting knob 220 may have a screw bar shape so that one end thereof is inserted into the supporting hole 227 formed on the contacting member 211 and is rotatably and supportably secured in the supporting hole 227 and the other end thereof has the gripper 223. In this embodiment, since the adjusting knob 220 moves together with the contacting member 211 of the supporting knob 210 as a single body, it does not require the coil spring 215 that is disposed between the contacting member 211 and an inner surface of the sidewall 246*a* of the carrier 246 to press the contacting member 211 toward the side surface 241*a* of the mono print head 241.

The resilient pressing unit 249 is a plate spring that is disposed between the other side surface 241*b* disposed opposite to the side surface 241*a* of the mono print head 241 and the intermediate wall 246*b* of the carrier 246 facing the other side surface 241*b* of the mono print head 241 to resiliently press the print head 241 toward the contacting member 211 of the supporting knob 210.

One end of the plate spring 249 is securely supported by the intermediate wall 246*b* through a spring fixing hole 250 formed on the intermediate wall 246*b* of the carrier 246, and the other end of the plate spring 249 contacts the other side surface 241*b* of the mono print head 241.

In a case that the supporting knob 210 includes the coil spring 215 disposed between the wall 246*a* of the carrier 246 and the contacting member 211and winding around the screw bar so that one end of the coil spring 215 rotatably contacts the contacting member 211, it is possible that the plate spring 249 has a greater resilient force than that of the coil spring 215. Accordingly, when the adjusting knob 220 is released from the screw hole 227, the plate spring 249 is enabled to push the mono print head 241 and the contacting member 211 in the direction "B" against the resilient force of the coil spring 215.

Also, the stitching adjustment unit 201 includes a securing member (not shown) securing the adjusting knob 220 at an adjustment position after the orientation of the mono print head 241 is adjusted by the adjusting knob 220.

The securing member may include a plurality of first screw holes or pin holes (not shown) formed on the gripper 223, a plurality of second screw holes or pin holes (not shown) formed on the sidewall 246*a* of the carrier 246 in a circular shape, and screws or pins (not shown) screwed (inserted) into corresponding ones of the first and second screw holes or the pin holes not to rotate the adjusting knob 220 with respect to the carrier 246.

Another print head position adjusting apparatus (200') for the color print head 242 has another stitching adjustment unit 201' disposed at a second sidewall 246*c* of the carrier 246 and another resilient pressing unit 249' disposed between the intermediate wall 246*b* of the carrier 246 and the color print head 242.

Since the another stitching adjustment unit 201' and the another resilient pressing unit 249' of the another print head position adjusting apparatus 200' for the color print head 242 are identical to the stitching adjustment unit 201 and the resilient pressing unit 249 of the print head position adjusting apparatus 200 for the mono print head 241, respectively, descriptions thereof are omitted.

Although the stitching adjustment unit 201 and the resilient pressing unit 249 are respectively disposed between the intermediate wall 246*b* and the sidewall 246*a* of the carrier 246 or the second sidewall 246*c* in this embodiment, it should not be considered as limiting. Accordingly, it is understood that the stitching adjustment unit 201 and the resilient pressing unit 249 are disposed at any positions if they adjust the orientation of the print head 241, for example, at a front wall and a rear wall of the carrier 246.

A method of adjusting the orientation of the mono and/or color print heads 241 and/or 242 using the print head position adjusting apparatus 200 of the ink jet printer having the above structure is described with reference to FIGS. 5 to 8.

When there occurs "stitching" during printing, an orientation of the mono or color print head 241 or 242 is adjusted based on a stitching angle of the mono and/or color print heads 241 and/or 242. The stitching angle is formed between the side surface 241*a* of the mono print head 241 and a plane perpendicular to the carrier shaft.

For example, when the mono print head 241 is slightly tilted to the left side with respect to a center line of the carrier as shown in FIG. 8A, i.e., when the stitching angle is tilted to the left side, the adjusting knob 220 is rotated in one direction, e.g., a clockwise direction with respect to the screw bar 221, to be inserted into the screw hole 227 of the sidewall 246*a* of the carrier 246, thereby pushed by the front portion of the side surface 241*a* of the print head 241 in the direction "A", i.e., to the left side of the drawing. Thus, the side surface 241 of the mono print head 241 becomes parallel to a plane of the carrier 246 perpendicular to the carrier shaft, thereby arranging a moving direction of nozzles of the mono print head 241 to be parallel to the carrier shaft or to be perpendicular to a feeding direction of a sheet of paper.

As the adjusting knob 220 is inserted into the screw hole 227, the contacting member 211 of the supporting knob 210 contacting the one end of the adjusting knob 220 pushes the front portion of the side surface 241*a* of the mono print head 241against the resilient force of the plate spring 249.

As described above, when the mono print head 241 is positioned uprightly by being pushed to the left side at the front portion thereof, the ink jet printer performs a test printing.

As a result of the test printing, if there does not occur the "stitching," the adjusting knob 220 is secured to the sidewall 246*a* of the carrier 246 by the securing members, such as a pin, a screw or the like, and adjusting work is finished.

However, if there still occurs the stitching where the stitching angle is tilted to the left side, the above-described procedure is repeated.

Also, if there occurs the stitching where the stitching angle is tilted toward the right side of the drawing due to an excessive rotation of the adjusting knob 220 in a clockwise direction, the adjusting knob 220 is rotated in the other direction, i.e., in a counter clockwise direction, to be released from the screw hole 227 of the sidewall 246*a* of the carrier 246, thereby moving the front portion of the side surface 241*a* of the print head 241 in the direction of "B", i.e., to the right side of the drawing.

As the adjusting knob 220 is released from the screw hole 227, the contacting member 211 of the supporting knob 210 contacting the one end of the adjusting knob 220, and the front portion of the side surface 241*a* of the print head 241are pushed by the plate spring 249 to the right side against the coil spring 215.

As described above, when the mono print head 241 is positioned upright by being pushed to the right side at the front portion thereof, the ink jet printer performs the test printing. According to the result of the test printing, the adjusting knob 220 is secured to the adjustment position and the adjusting work is completed. Otherwise, the above-described operation is repeated.

As described above, the print head position adjusting apparatus 200 of the ink jet printer according to the present invention is capable of adjusting the orientations of the mono and color print heads 241 and 242 mounted in the carrier 246 with a relatively simplified structure, thereby preventing the stitching problem that is caused by the misalignment of the mono and color print heads 241 and 242.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and structural equivalents.

What is claimed is:

1. A print head position adjusting apparatus of an ink jet printer which includes at least one print head performing printing by ejecting ink and a carrier containing the print head therein and moving along a carrier shaft, the print head position adjusting apparatus comprising:

at least one stitching adjustment unit disposed at the carrier to adjust an orientation of the print head with respect to the carrier; and at least one resilient pressing unit resiliently pressing the print head toward the stitching adjustment unit.

2. The print head position adjusting apparatus of claim 1, wherein the stitching adjustment unit comprises:

a supporting knob movably disposed at a wall of the carrier to press a surface of the print head facing the wall of the carrier; and an adjusting knob disposed at the wall of the carrier to push or release the supporting knob toward or from the surface of the print head.

3. The print head position adjusting apparatus of claim 2, wherein the supporting knob comprises:

a contacting member having a contacting surface to be in contact with the surface of the print head; and a supporting hook being supported on the wall of the carrier to move the contacting member within a predetermined range with respect to the wall of the carrier.

4. The print head position adjusting apparatus of claim 3, wherein:

the wall of the carrier comprises, the adjusting knob comprises, a screw bar that is screwed into the screw hole formed on the wail of the carrier and has one end rotatably contacting the contacting member and the other end having a gripper.

5. The print head position adjusting apparatus of claim 4, wherein the gripper comprises:

a plurality of rips to be easily held a hand of a user.

6. The print head position adjusting apparatus of claim 3, wherein:

the wail of the carrier comprises, a screw hole; and the adjusting knob comprises, a screw bar that is screwed into the screw hole formed on the wall of the carrier and has one end rotatably secured to and supported on the contacting member and the other end having a gripper.

7. The print head position adjusting apparatus of claim 2, wherein the supporting knob further comprises:

a resilient spring disposed between the contacting member and the wall of the carrier to press the contacting member toward the surface of the print head.

8. The print head position adjusting apparatus of claim 7, wherein the resilient spring comprises:

a coil spring.

9. The print head position adjusting apparatus of claim 2, wherein the resilient pressing unit comprises:

at least one resilient spring disposed between a second surface of the print head disposed opposite to the surface of the print heat and a second wall of the carrier disposed opposite to the other surface of the print head to resiliently press the print head toward the supporting knob.

10. The print head position adjusting apparatus of claim 9, wherein the resilient spring comprises:

a plate spring having one end fastened to and supported on the second wail of the carrier and the other end contacting the second surface of the print head.

11. The print head position adjusting apparatus of claim 10, wherein:

the supporting knob comprises, a contacting member having a contacting surface to be in contact with a surface of the print head, and a supporting hook being supported on the wall of the carrier to move the contacting member within a predetermined range, and a coil spring disposed between the contacting member and the wall of the carrier to press the contacting member toward the surface of the print head;

the wall of the carrier comprises, a screw hole;

the adjusting knob comprises, a screw bar that is screwed into the screw hole formed on the wall of the carrier and has one end rotatably contacting the contacting member and the other end having a gripper; and the plate spring has a resilient force greater than that of the coil spring so that the print head moves toward the supporting knob as the adjusting knob is released from the wall of the carrier.

12. The print head position adjusting apparatus of claim 2, wherein the stitching adjustment unit comprises:

a securing member securing the adjusting knob at an adjustment position after the orientation of the print head is adjusted by the adjusting knob.

13. The print head position adjusting apparatus of claim 12, wherein the securing member comprises:

a plurality of first holes formed on the adjusting knob;

a plurality of second holes formed on the wall of the carrier; and one of a screw and a pin inserted into corresponding ones of the first holes of the adjusting knob and the second holes of the wall of the carrier, so that a rotation of the adjusting knob with respect to the wall of the carrier is prevented.

14. A print head position adjusting apparatus of an ink jet printer which includes a carrier shaft and a carrier moving along the carrier shaft and having first, second, and intermediate sidewalls to contain a mono print head between the first and intermediate sidewalls and a color print head between the intermediate and second sidewalls to perform printing on a sheet of paper, the print head position adjusting apparatus comprising:

a first stitching adjusting unit formed on the first sidewall to push the mono print head toward a first side of the intermediate sidewall facing the first sidewall;

a second stitching adjusting unit formed on the second sidewall to push the color print head toward a second side of the intermediate sidewall facing the second sidewall;

a first resilient member disposed on the first side of the intermediate sidewall to push the mono print head toward the first sidewall; and a second resilient member disposed on the second side of the intermediate sidewall to push the color print head toward the second sidewall.

15. The print head position adjusting apparatus of claim 14, wherein the first, second, and intermediate sidewalls are parallel to each other and perpendicular to the carrier shaft.

16. The print head position adjusting apparatus of claim 14, wherein the mono print head comprises first and second side surfaces facing the first sidewall and the intermediate sidewall, respectively, and the first stitching adjusting unit adjusts the first side surface of the mono print head toward a plane perpendicular to the carrier shaft.

17. The print head position adjusting apparatus of claim 16, wherein the color print head comprises third and fourth side surfaces facing the second sidewall and the intermediate sidewall, respectively, and the second stitching adjusting unit adjusts the third side surface of the color print head toward the plane perpendicular to the carrier shaft.

18. The print head position adjusting apparatus of claim 14, wherein the first stitching adjusting unit is disposed on a first line parallel to the carrier shaft and spaced-apart from the carrier shaft by a first distance, and the first resilient member is disposed on a second line parallel to the carrier shaft and spaced-apart from the carrier shaft by a second distance.

19. The print head position adjusting apparatus of claim 18, wherein the mono print head comprises first and second side surfaces and a common center line passing through center portions of the first and second side surfaces, and the first line and the second line are disposed on opposite sides of the common center line.

20. The print head position adjusting apparatus of claim 19, wherein the first line is spaced-apart from the common center line by a third distance, and second line is spaced-apart from the common center line by a fourth distance.

21. The print head position adjusting apparatus of claim 20, wherein the third distance and the fourth distance are the same.

22. The print head position adjusting apparatus of claim 14, wherein the second stitching adjusting unit is disposed on a first line parallel to the carrier shaft and spaced-apart from the carrier shaft by a first distance, and the second resilient member is disposed on a second line parallel to the carrier shaft and spaced-apart from the carrier shaft by a second distance.

23. The print head position adjusting apparatus of claim 22, wherein the color print head comprises first and second side surfaces and a common center line passing through center portions of the first and second side surfaces, and the first line and the second line are disposed on opposite sides of the common center line.

24. The print head position adjusting apparatus of claim 23, wherein the first line is spaced-apart from the common center line by a third distance, and second line is spaced-apart from the common center line by a fourth distance.

25. The print head position adjusting apparatus of claim 24, wherein the third distance and the fourth distance are the same.

26. The print head position adjusting apparatus of claim 14, wherein the first and second stitching adjusting units are disposed on a first line passing through the first, second, and intermediate sidewalls, and the first and second resilient members disposed on a second line passing through the first, second, and intermediate sidewalls.

27. The print head position adjusting apparatus of claim 26, wherein the first line is spaced-apart from the carrier shaft by a first distance in a direction perpendicular to the carrier shaft, and the second line is spaced-apart from the carrier shaft by a second distance in the direction perpendicular to the carrier shaft.

28. The print head position adjusting apparatus of claim 27, wherein the mono and color print heads comprise first and second side surfaces and a common center line passing through center portions of the first and second side surfaces, and the first line and the second line are disposed on opposite sides of the common center line.

29. The print head position adjusting apparatus of claim 28, wherein the first line is spaced-apart from the common center line by a third distance, and second line is spaced-apart from the common center line by a fourth distance.

30. The print head position adjusting apparatus of claim 29, wherein the third distance and the fourth distance are the same.

31. The print head position adjusting apparatus of claim 14, wherein:

the first sidewall comprises, a screw hole; and the first stitching adjusting unit comprises, a supporting knob disposed between the mono print head and an inside surface of the first sidewall to protrude toward the mono print head, an adjusting knob disposed on an outside surface of the first sidewall, and a screw bar connected between the supporting knob and the adjusting knob through the screw hole of the first sidewall.

32. The print head position adjusting apparatus of claim 31, wherein:

the first sidewall comprises, a slide groove; and the supporting knob of the first stitching adjusting unit comprises, a contacting member contacting the mono-print head, and a supporting hook extended from the contracting member toward the adjusting knob through the slide groove of the first sidewall.

33. The print head position adjusting apparatus of claim 32, wherein the supporting hook of the supporting knob comprises:

a distal end protruding from the outside surface of the first sidewall and having a thickness thicker than the side groove of the first sidewall.

34. The print head position adjusting apparatus of claim 31, wherein first stitching adjusting unit comprises:

a third resilient member disposed between the supporting knob and the first sidewall.

35. The print head position adjusting apparatus of claim 14, wherein:

the second sidewall comprises, a screw hole; and the second stitching adjusting unit comprises, a supporting knob disposed between the color print head and an inside surface of the second sidewall to protrude toward the color print head, an adjusting knob disposed on an outside surface of the second sidewall, and a screw bar connected between the supporting knob and the adjusting knob through the screw hole of the second sidewall.

36. The print head position adjusting apparatus of claim 35, wherein:

the second sidewall comprises, a slide groove; and the supporting knob of the second stitching adjusting unit comprises, a contacting member pushing the color-print head, and a supporting hook extended from the contracting member toward the adjusting knob through the slide groove.

37. The print head position adjusting apparatus of claim 36, wherein the supporting hook of the supporting knob protrudes from the outside surface of the second sidewall.

38. The print head position adjusting apparatus of claim 36, wherein second stitching adjusting unit comprises:

a third resilient member disposed between the supporting knob and the second sidewall.

39. A print head position adjusting apparatus of an ink jet printer which includes a carrier shaft and a carrier moving along the carrier shaft and having first and second sidewalls to contain a print head between the first and second sidewalls to perform printing on a sheet of paper, the print head position adjusting apparatus comprising:

a stitching adjusting unit formed on the first sidewall to cause the print head to move with respect to the carrier; and a resilient member disposed on an inside of the second sidewall facing the first sidewall to push the print head toward the first sidewall.

40. The print head position adjusting apparatus of claim 39, wherein the first and second sidewalls are parallel to each other and perpendicular to the carrier shaft.

41. The print head position adjusting apparatus of claim 39, wherein the print head comprises first and second side surfaces facing the first sidewall and the second sidewall, respectively, and the stitching adjusting unit adjusts the first side surface of the print head to move toward a plane perpendicular to the carrier shaft.

42. The print head position adjusting apparatus of claim 39, wherein the stitching adjusting unit is disposed on a first line parallel to the carrier shaft and spaced-apart from the carrier shaft by a first distance, and the silent member is disposed on a second line parallel to the carrier shaft and spaced-apart from the carrier shaft by a second distance.

43. The print head position adjusting apparatus of claim 42, wherein the print head comprises first and second side surfaces and a common center line passing through center portions of the first and second side surfaces, and the first line and the second line are disposed on opposite sides of the common center line.

44. The print head position adjusting apparatus of claim 43, wherein the first line is spaced-apart from the common center line by a third distance, and second line is spaced-apart from the common center line by a fourth distance.

45. The print head position adjusting apparatus of claim 44, wherein the third distance and the fourth distance are the same.

46. The print head position adjusting apparatus of claim 43, wherein first and second sidewalls comprise another common center line parallel to the carrier shaft, and the common center line of the print head is rotated toward the another common center line of the first and second sidewalls when the stitching adjusting unit is adjusted to move with respect to the first sidewall.

47. A print head position adjusting apparatus of an ink jet printer which includes a carrier shaft and a carrier moving along the carrier shaft and having first, second, and intermediate sidewalls to contain a mono print head between the first and intermediate sidewalls and a color print head between the intermediate and second sidewalls to perform printing on a sheet of paper, the print head position adjusting apparatus comprising:

a first stitching adjusting unit formed on the first sidewall to protrude toward a plane disposed on the intermediate sidewall;

a second stitching adjusting unit formed on the second sidewall to protrude toward the intermediate sidewall;

a first resilient member disposed on a first side of the intermediate sidewall facing the first sidewall to protrude toward the first sidewall; and a second resilient member disposed on a second side of the intermediate sidewall facing the second sidewall to protrude toward the second sidewall.

48. A print head position adjusting apparatus of an ink jet printer which includes a carrier shaft and a carrier moving along the carrier shaft and having first and second sidewalls, which are parallel to each other and perpendicular to the carrier shaft to contain a print head between the first and second sidewalls to perform printing on a sheet of paper, the print head position adjusting apparatus comprising:

a stitching adjusting unit formed on the first sidewall to protrude toward the second sidewall and to move the print head with respect to the carrier; and a resilient member disposed on an inside of the second sidewall facing the first sidewall to protrude toward the first sidewall.

49. A method in a print head position adjusting apparatus of an ink jet printer which includes a carrier shaft and a carrier moving along the carrier shaft and having first, second, and intermediate sidewalls to contain a mono print head between the first and intermediate sidewalls and a color print head between the intermediate and second sidewalls to perform printing on a sheet of paper, the method comprising:

causing a first stitching adjusting unit to be formed on the first sidewall;

causing a second stitching adjusting unit to be formed on the second sidewall;

causing a first resilient member to be disposed on a first side of the intermediate sidewall facing the first sidewall to push the mono print head toward the first sidewall;

causing a second resilient member to be disposed on a second side of the intermediate sidewall facing the second sidewall to push the color print head toward the second sidewall;

moving the first stitching adjusting unit to push the mono print head toward the intermediate sidewall; and moving the second stitching adjusting unit to push the color print head toward the intermediate sidewall.

50. A method in a print head position adjusting apparatus of an ink jet printer which includes a carrier shaft and a carrier moving along the carrier shaft and having first and second sidewalls to contain a print head between the first and second sidewalls to perform printing on a sheet of paper, the method comprising:

causing a stitching adjusting unit to be formed on the first sidewall, the stitching adjustment unit to move the print head with respect to the carrier;

causing a resilient member to be disposed on an inside of the second sidewall facing the first sidewall to push the print head toward the first sidewall; and controlling the moving the stitching adjusting unit to push the print head toward the second sidewall.

51. The method of claim 50, wherein the first and second sidewalls are parallel to each other and perpendicular to the carrier shaft, the print head comprises first and second side surfaces facing the first sidewall and the second sidewall, respectively, and the controlling of the moving the stitching adjusting unit comprises:

rotating the print head with respect to a plane perpendicular to the carrier shaft.

52. The method of claim 50, wherein the stitching adjusting unit is disposed on a first line parallel to the carrier shaft and spaced-apart from the carrier shaft by a first distance, the elastic member is disposed on a second line parallel to the carrier shaft and spaced-apart from the carrier shaft by a second distance, and the controlling of the moving the stitching adjusting unit comprises:

rotating the print head with respect to a plane perpendicular to the carrier shaft.

* * * * *

UNITED STATES PATENT AND TRADEMARK OFFICE

CERTIFICATE OF CORRECTION

PATENT NO. : 6,981,755 B2
APPLICATION NO. : 10/442253
DATED : January 3, 2006
INVENTOR(S) : Gui-taek Lim It is certified that error appears in the above-identified patent and that said Letters Patent is hereby corrected as shown below:

Column 9, line 3, Claim 4, replace “wail” with --wall--, therefor;

Column 9, line 11, Claim 6, replace “wail” with --wall--, therefor;

Column 9, line 31, Claim 9, replace “print heat” with --print head--, therefor;

Column 9, line 38, Claim 10, replace “wail” with --wall--, therefor;

Column 13, line 2, Claim 42, replace “silent” with --resilient--, therefor;

Column 14, line 37, Claim 50, after “controlling” insert --of--.

Signed and Sealed this

Twenty-second Day of January, 2008

JON W. DUDAS
*Director of the United States Patent and Trademark Office*